US005279709A

United States Patent [19]

Niskanen

[11] Patent Number: 5,279,709

[45] Date of Patent: Jan. 18, 1994

[54] METHOD AND APPARATUS FOR IMPROVING THE CONTROL AND TREATMENT OF FIBER SUSPENSION FLOW

[75] Inventor: Toivo Niskanen, Hamina, Finland

[73] Assignee: A. Ahlstrom, Noormarkku, Finland

[21] Appl. No.: 738,815

[22] Filed: Aug. 1, 1991

Related U.S. Application Data

[63] Continuation-in-part of Ser. No. 408,129, Sep. 15, 1989, abandoned, which is a continuation-in-part of Ser. No. 159,324, Feb. 23, 1988, abandoned.

[30] Foreign Application Priority Data

Feb. 23, 1987 [FI] Finland ..... 870747

[51] Int. Cl.[5] ..... D21C 3/22

[52] U.S. Cl. ..... 162/52; 162/57; 241/46.11; 366/168; 95/156; 95/218; 95/260; 96/181; 96/217

[58] Field of Search ..... 162/52, 57, 261, 21, 162/246, 343, 336; 241/46.11, 46.17, 28; 366/182, 194, 168, 176; 55/203, 52

[56] References Cited

U.S. PATENT DOCUMENTS

| | | | |
|---|---|---|---|
| 2,911,334 | 11/1959 | Stuck | 241/46.11 |
| 3,060,862 | 10/1962 | Neidl | 241/46.11 |
| 3,120,353 | 2/1964 | Neidle | 241/46.11 |
| 3,366,367 | 1/1968 | Tofte | 366/270 |
| 4,427,489 | 1/1984 | Jacobsen | 162/57 |

*Primary Examiner*—W. Gary Jones
*Assistant Examiner*—Brenda Adele Lamb
*Attorney, Agent, or Firm*—Cohen, Pontani, Lieberman, Pavane

[57] ABSTRACT

A method and apparatus for controlling the flow of a fiber suspension having a direction of flow and a consistency from 5-25% including a treatment chamber having an axis extending in the direction of flow of the fiber suspension, a suspension inlet and a suspension outlet opposite the suspension inlet, the suspension inlet and outlet having the same diameter and an axis in alignment with the axis of said treatment chamber;

a fluidizing rotor within the chamber for fluidizing the fiber suspension, the fluidizing rotor having an axis of rotation transverse to the axis of the treatment chamber; and a throttling arrangement disposed between the rotor and the suspension outlet for throttling the suspension flow.

6 Claims, 10 Drawing Sheets

METHOD AND APPARATUS FOR IMPROVING THE CONTROL AND TREATMENT OF FIBER SUSPENSION FLOW

This application is a continuation-in-part of application Ser. No. 07/408,129 filed Sep. 15, 1989, now abandoned, which is a continuation-in-part of application Ser. No. 07/159,324 filed Feb. 23, 1988, now abandoned.

FIELD OF THE INVENTION

The present invention relates to a method and an apparatus for improving the control and treatment of a fiber suspension flow. The method and apparatus according to the invention are particularly suitable to be used for mixing chemicals and for simultaneously controlling the pumping of high consistency pulp in the pulp and paper industry.

BACKGROUND OF THE INVENTION

Medium and high consistency pulp (consistency 8-30%) forms a very stiff material; it can be so stiff that one can stand with ordinary shoes on the pulp and not sink into the pulp. The reason for it is that fiber with the length of a few millimeters form a strong-three dimensional fiber network. The fibers are rather rigid and when they rest on each other they form a strong structure.

High consistency pulp is still generally pumped by a displacement pump or a screw pump. This was up till now the only way to pump high consistency pulp. When the pulp is pumped by such pumps, no control valve is used in the discharge side. There are two reasons for that. Firstly, high consistency pulp is stiff and the pumps produce a pulsating pressure. If there is a throttling in the discharge side, it produces strong pressure pulses in the pipe system, which can break structures. Secondly, a displacement pump works even though if there is no pulp in the suction side or so little pulp that it would only partly fill the compartments of the pump. The pump can work so that it pumps forward everything that comes from the suction side to the compartments.

High consistency pulp can, however, be changed momentarily into a flowing state by the breaking fiber network by bringing shear forces to the suspension. This is called fluidization of high consistency pulp. Normally fluidization is effected by some kind of powerful rotor. For example, in a high consistency pump the rotor effects the fluidization in the suction duct of the pump. Fluidization is a reversible process, and as soon as the rotor is stopped or the pulp is no longer in the range of the rotor, the fiber network is formed again and the suspension becomes again a substantially solid material.

Lately, a new type of high consistency pump has become accepted in the mills, cf., e.g. U.S. Pat. No. 4,435,122. This new kind of pump is a centrifugal pump, in which high consistency pulp is fluidized, in other words changed into a flowing state just before the pulp reaches the range of the pump impeller. With this technique in pumping high consistency pulp it is usually necessary to assemble a control valve in the discharge side of the pump according to FIG. 1 in order to ensure that there is always pulp in the suction side of the pump or that the amount of the pulp to be pumped is correct. Reason for this is the fact that a centrifugal pump always has to have its inlet opening filled with pulp and thus its operation is most often controlled in such a way that the pulp level in the vessel prior to the pump is maintained substantially constant by means of throttling the discharge of the pump.

If the capacity of a pump is adjusted by a control valve according to FIG. 1, the head of the pump is considerably lowered in the control valve because of the rigid character of the pulp. In controlling the flow of high consistency pulp the resistance i.e. pressure drop is often several bars even with the best valves known.

Often in pulp mills a pulp pump is followed by yet another device, namely a mixer for mixing chemicals into the pump, for example, in bleaching. The mixing may be effected either in a separate mixer or in a high consistency pump. When chemicals are mixed in a medium/high consistency pump, they are added either before the pump or at the outer rim of the impeller. If this is done, a separate mixer is not necessary, but the same device may serve both as a mixer and a pump. However, if the chemicals are in the form of gases they cannot be added before the pump as centrifugal pumps pumping medium or high consistency pulp are usually provided with means for separating gas from pulp whereby the chemicals would be the first gases to be separated.

Often a pump cannot be used as a mixer for several reasons. Such may be, for example, material problems or the fact that the amount or the quality of the chemicals in such that the chemicals cannot be added into the pump. Hereby one has to use a separate mixer according to FIG. 2. There are cases in which part of the chemicals may be fed to the pump and the rest to the mixer or all chemicals to the mixer depending on the situation.

A mixer being used in connection with medium or high consistency pulps consists of a substantially cylindrical casing with an axial inlet opening and an axial outlet opening and protrusions on the inner surface, of an axially rotating rotor which has protrusions on the outer surface, and of a feed duct for chemicals which opens to a substantially annular mixing zone between the rotor and the casing. Said mixer, although very practical and reliable, is, however, rather complicated to manufacture of special material. This kind of a mixer has still a severe drawback relating to its operation. After being efficiently mixed with the chemicals and having started to rotate in the mixing zone due to the rotation of the rotor the pulp leaves the annular mixing zone in a direction coaxial with the rotor whereby the rotational movement of the pulp continues and the pulp tends to form a rotating annulus on the wall of the flow channel. Also the pressure in the pulp decreases rapidly as the flow area of the pulp suddenly increases. The result of these two factors is that the gases, i.e. most often the chemicals, tend to separate in the middle of the flow starting to form gas bubbles. Thus the mixing of the chemicals with the pulp is not as efficient and even as could be expected.

As one can note from the foregoing there are several different devices utilized in connection with the pulp pump, namely the pump itself, the control valve and a chemical mixer. A purpose of the present invention is to combine these devices in such a way that the result would be most economical in the point of view of both the manufacturer of the devices and their users.

It would, of course, be possible to combine all of the above mentioned three devices together, but there is one factor which makes it practically impossible. As explained above, the chemicals may be mixed within the pump, wherefore the pump perhaps should be manufactured of a more durable material, but not always. However, when pumping medium or high consistency pulps the control valve should be arranged so close to the pump impeller that the fluidized pulp would not have time to reverse back into plug flow by forming a fiber network. It is to be noted at this stage that the discharge duct of a centrifugal pump is always tangential in order not to resist the flow out of the pump. On one hand, this kind of tangential arrangement would be impossible in case high consistency pulps were to be pumped, as the distance from the impeller blades maintaining the fluidized state at a sufficient level to the throttling arrangement arranged in a tangential discharge duct would be long enough for allowing the pulp to form fiber network, whereby an ordinary valve would either cause a high pressure loss or be entirely clogged. On the other hand, the discharge duct could be arranged substantially radially, whereby the above defined distance would be minimized, but the sharp turn in the volute flow from circumferential to radial would bring about a considerable drop in pressure substantially equalling the drop in an ordinary valve.

OBJECTS OF THE INVENTION

One basic object of the invention is to minimize the flow resistance of an adjustable valve or a stationary throttling by means of arranging a fluidizing rotor in connection with said throttling so that the high consistency pulp flows in a fluidized state through the throttling. As is further described below, FIG. 8*a* shows in principle, how dramatically the capacity of the prior art throttling arrangements decreases while the consistency is increased. FIG. 8*b* is a graph showing the capacity of a throttling arrangement provided with a fluidizer in accordance with the present invention. The reliability and adjustability of the throttling arrangement improve particularly with small valve openings or spread angles, enabling a far more accurate control of the pump resulting in more even and steady flow and pressure conditions in the discharge of the pump.

The most attractive object of the present invention is to eliminate the need of a separate mixer in addition to providing a separate throttling by means of a new kind of throttling arrangement and to utilize the fluidizing properties of said throttling arrangement for feeding chemicals prior to the throttling as well as to lower the total resistance of the system and to reduce the space requirement.

The present invention brings about the following advantages over the prior art.

- The throttling arrangement functions at high consistencies (15–30%).
- The throttling arrangement functions even at small opening angles without clogging and evenly with no need for excessive opening of the valve even at the starting point.
- The capacity of the throttling arrangement with pulp of a consistency of 15–20% practically equals the capacity with water and, when adjusting the pulp flow, operates at lower pressure differences than the prior valves (cf. FIG. 7).
- The separate prior art throttling arrangements and prior art mixers made of special materials are replaced by a valve mixer in accordance with the present invention.
- The total pressure loss is decreased.
- It is possible to raise the consistency level of the mixture up to a consistency of 25–30% which is impossible with the known devices.
- The construction of the throttling arrangement is such that it operates reliably regardless of the rate of inlet flow.

In the systems according to the prior art (FIG. 1) the aim has been to place the throttling arrangement in a small pipe close to the discharge side of the pump. Thus a high flow rate is achieved at the throttling arrangement, which makes the throttling arrangement operate better and prevents the clogging thereof. A throttling according to the invention and the arrangement using it can be placed anywhere in the piping. This kind of arrangement makes it possible to arrange the pump to the most appropriate location and arrange the valve mixer to another location most suitable for its operational purposes.

The arrangement utilizing the invention enables mixing of chemicals without the pump being the only place where the chemicals may be added. In many cases in bleaching processes, part of the chemicals can be added in the pump and the rest in the control valve. No separate mixer is needed. Thus the arrangement according to the prior art (FIG. 2) is essentially simplified.

A significant advantage of the present invention resides in the great possibilities for adjusting the volumetric flow. Because it is possible to fluidize the high consistency pulp just in front of the valve element, the valve opening can be throttled to its minimum and yet the pulp flow continues, in other words it is possible to reach low flow amounts even at high consistencies.

The defects and drawbacks of the arrangements according to the above explained alternatives can be eliminated or minimized and the foregoing advantages gained by the method and apparatus in accordance with the invention.

SUMMARY OF THE INVENTION

The apparatus in accordance with the present invention comprises a fluidizing element disposed within a chamber, a throttling having a reduced diameter with respect to the diameter of said chamber, said throttling being arranged downstream of said fluidizing element with respect to the flow direction of fiber suspension through said apparatus; said chamber having a diameter being equal to or less than the diameter of said inlet pipe and said outlet pipe.

The method in accordance with the present invention comprises

- feeding said suspension from the pulp line to said chamber,
- subjecting said suspension to shear forces and turbulence for loosening the bonds between individual fibers i.e. for fluidizing said suspension, the main axis of said turbulence being non-axial with said outlet and said throttling,
- simultaneously allowing said suspension to flow in a fluidized state through the open center of said fluidizing element,
- making said suspension flow through said throttling in at least partly fluidized state, and
- discharging said suspension from the chamber to the pulp line.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

The apparatus and method according to the present invention are described in detail below, by way of example, with reference to the accompanying drawings, in which:

FIGS. 1*a* and 1*b* are schematic illustrations of prior art pumping arrangements;

Figure 6A:
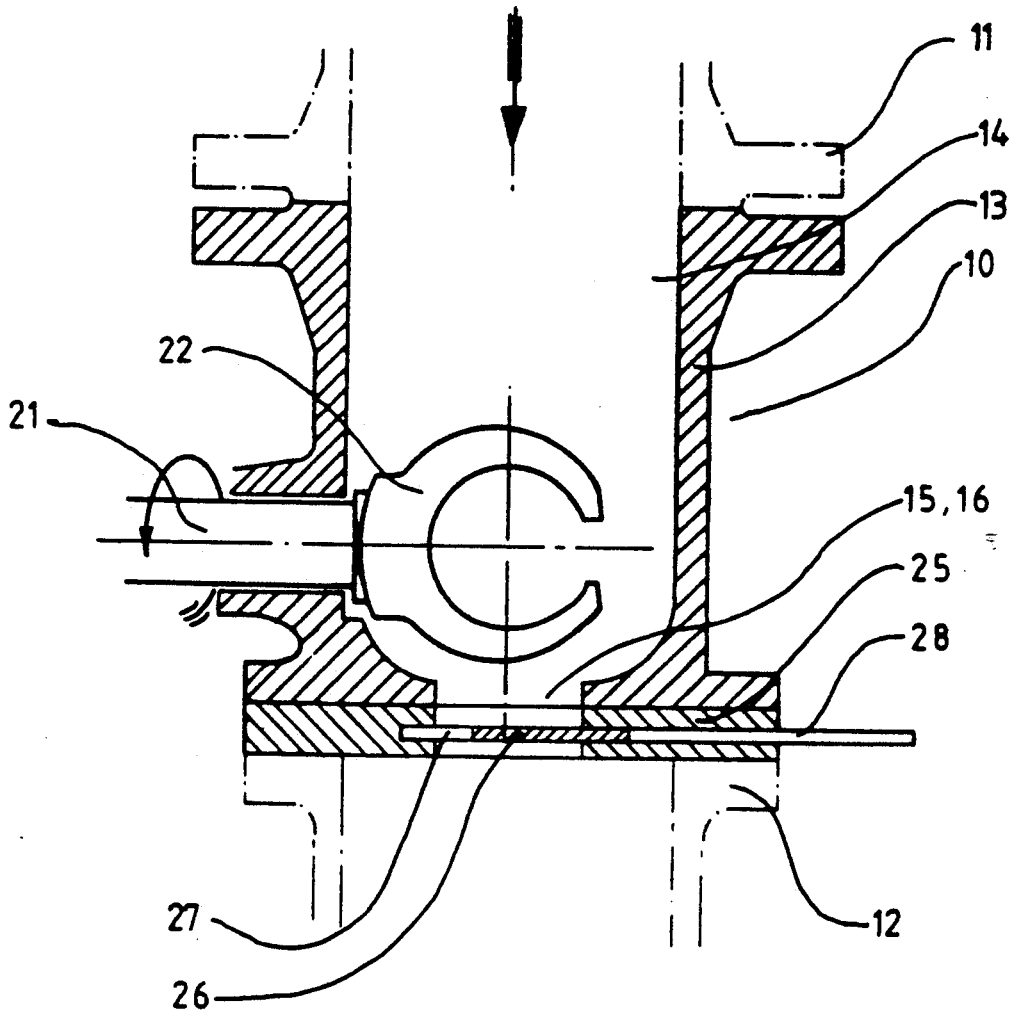
Figure 6B:
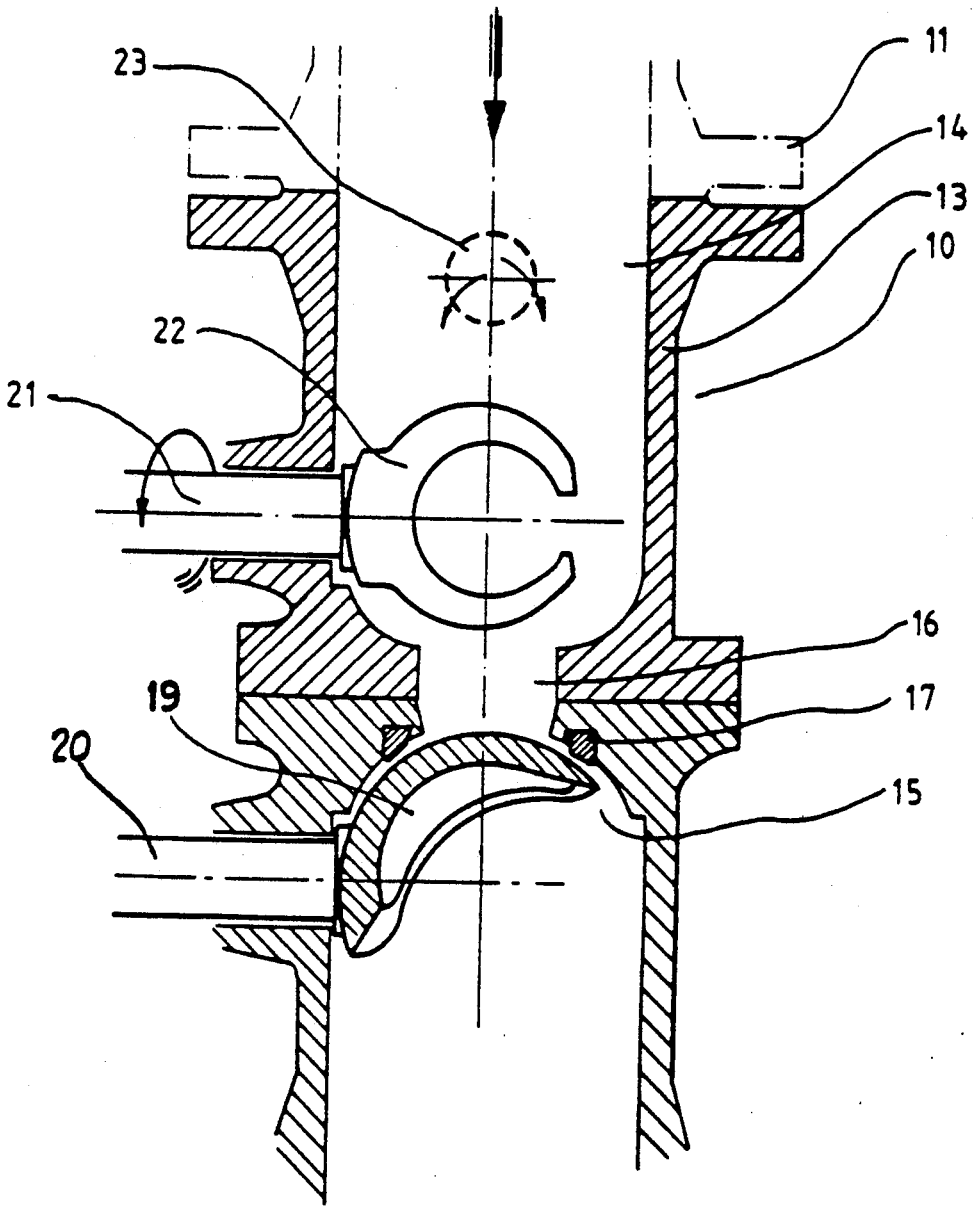
Figure 7:
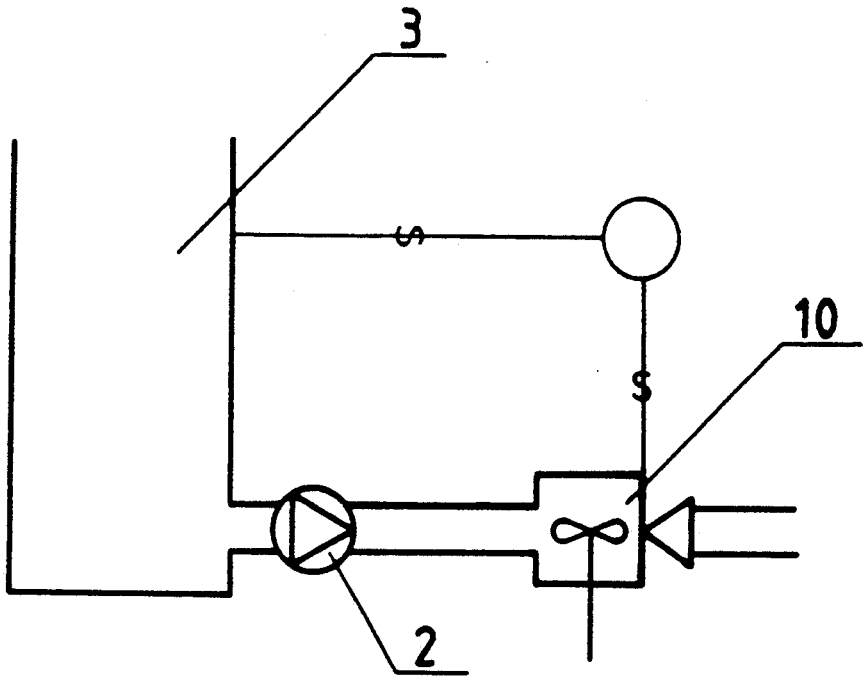
Figure 8A:
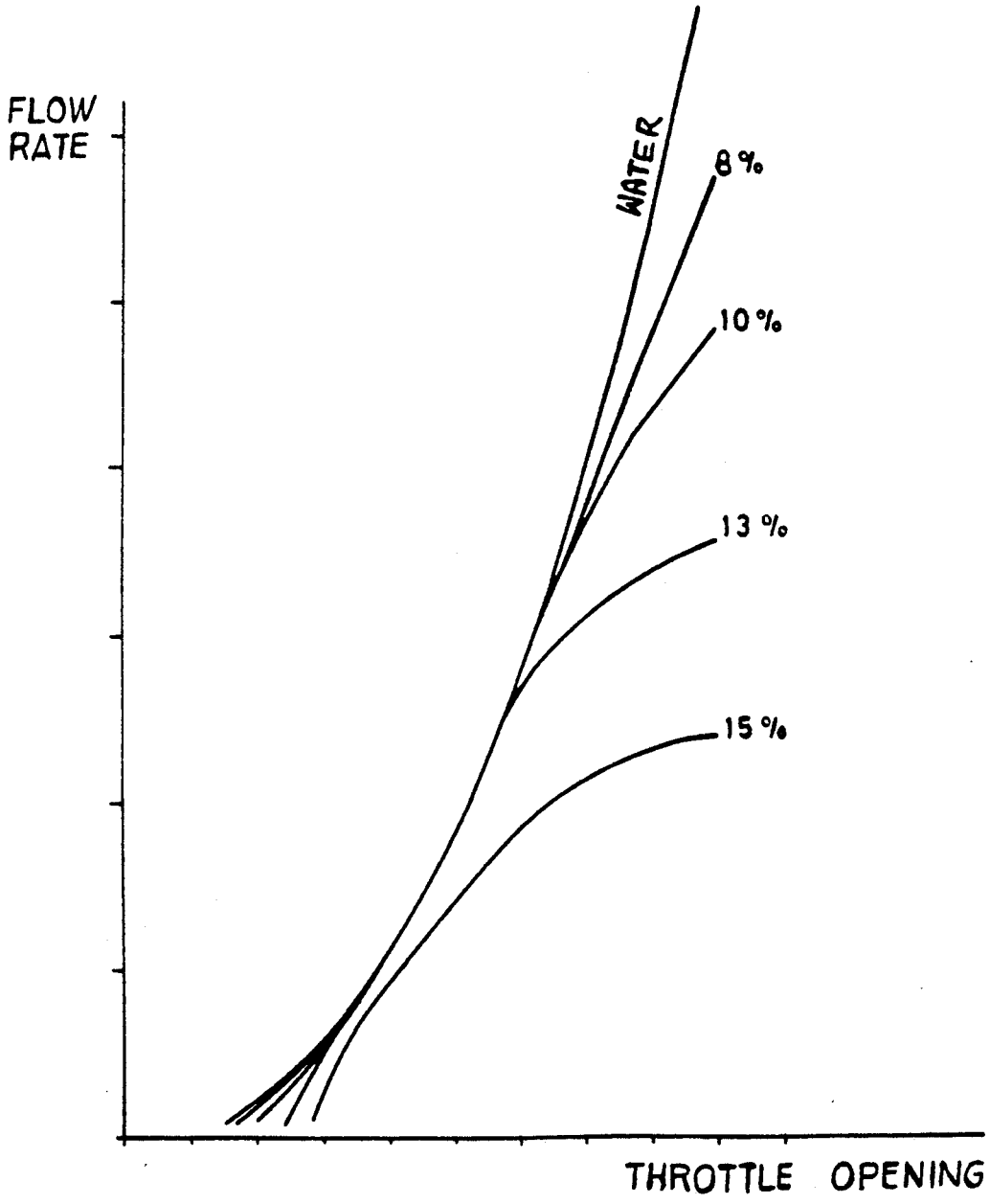
Figure 8B:
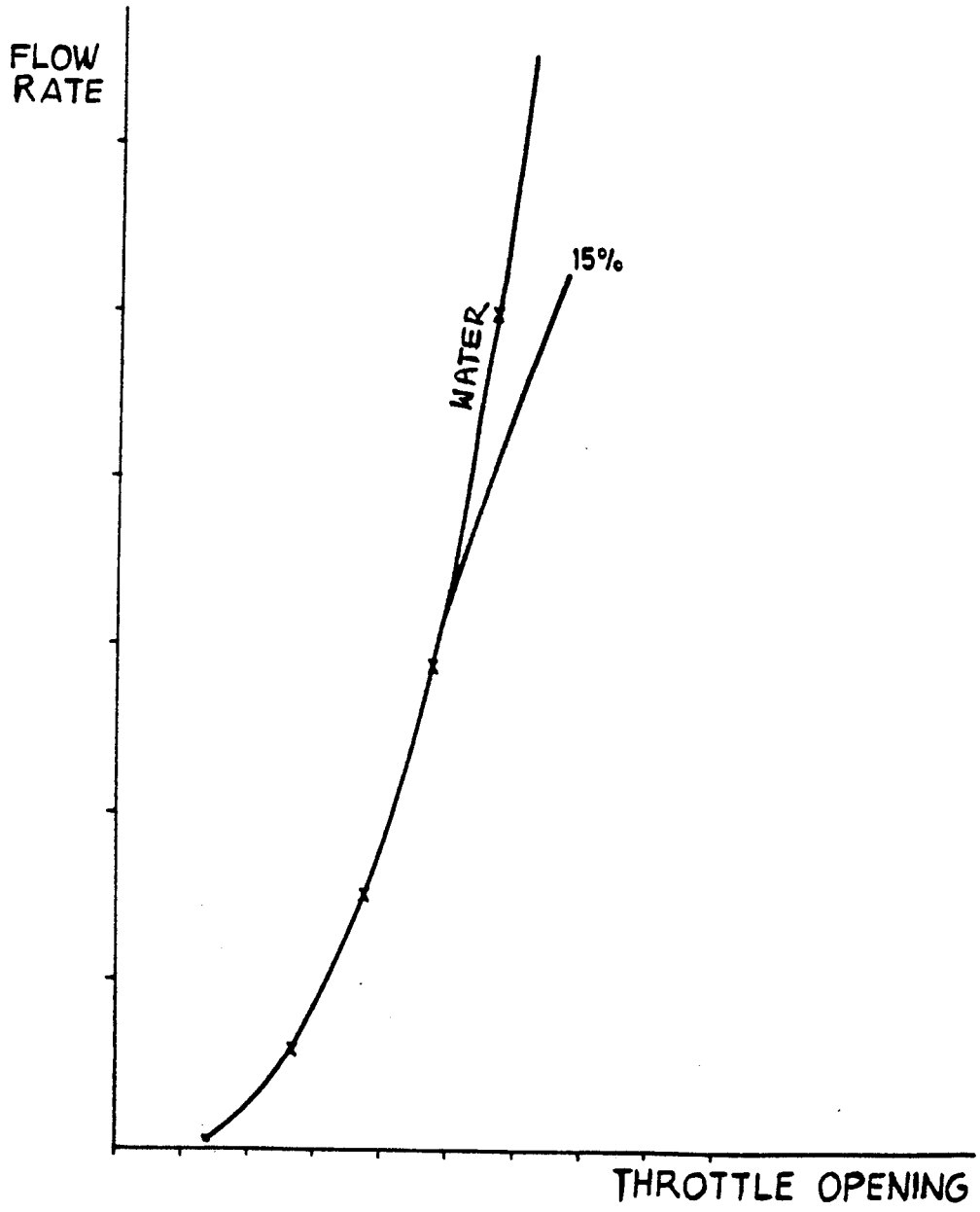
Figure 9:
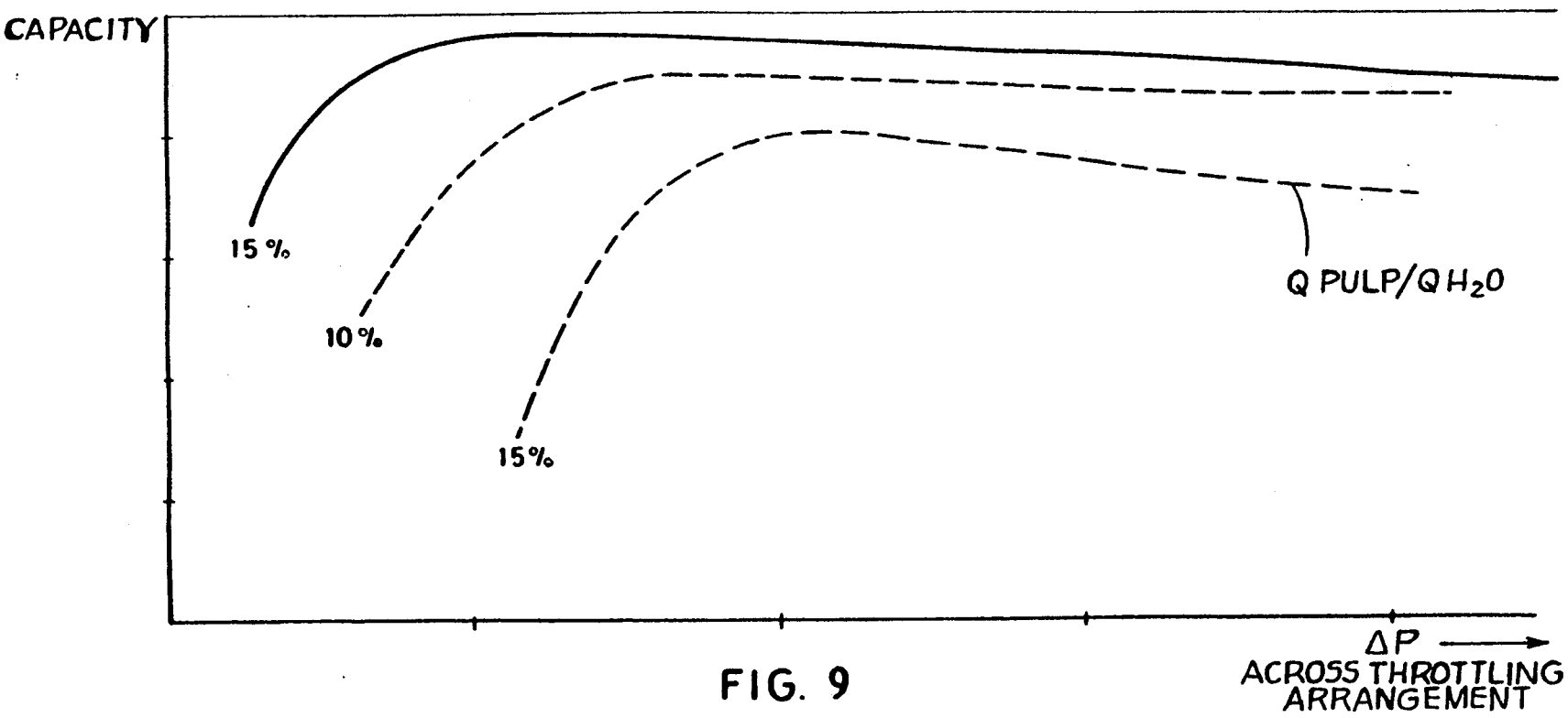

FIGS. 6*a* and 6*b* are sectional side views of further preferred embodiments of adjustable mixing valves according to the present invention;

FIG. 7 is a schematic illustration of a pumping arrangement including an adjustable mixing valve according to the present invention;

FIGS. 8*a* and 8*b* are graphs of flow-through curves of a throttling arrangement according to the prior art and a throttling arrangement according to the present invention with pulps of different consistencies compared with the flow-through curves of water; and FIG. 9 is a graph showing the comparison of corresponding throttling arrangements in relation to the amount of pulp flow-through to the amount of water flowing through as a function of pressure difference prevailing across the throttling arrangement.

DETAILED DESCRIPTION OF THE PRESENTLY PREFERRED EMBODIMENTS

Figure 1A:
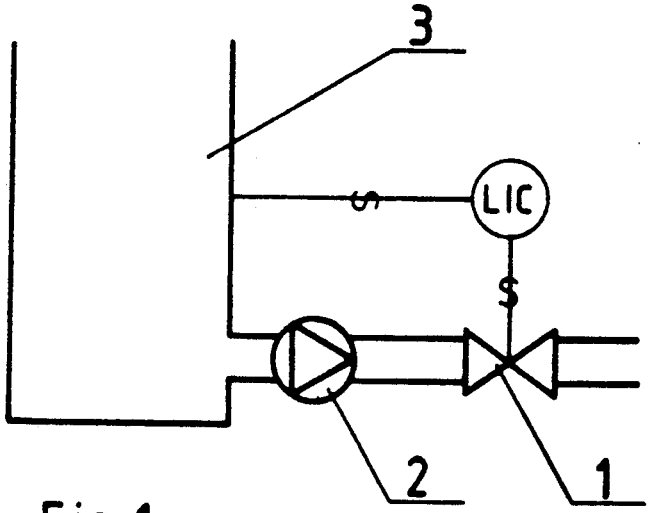
Fig 1a Prior art
Figure 1B:
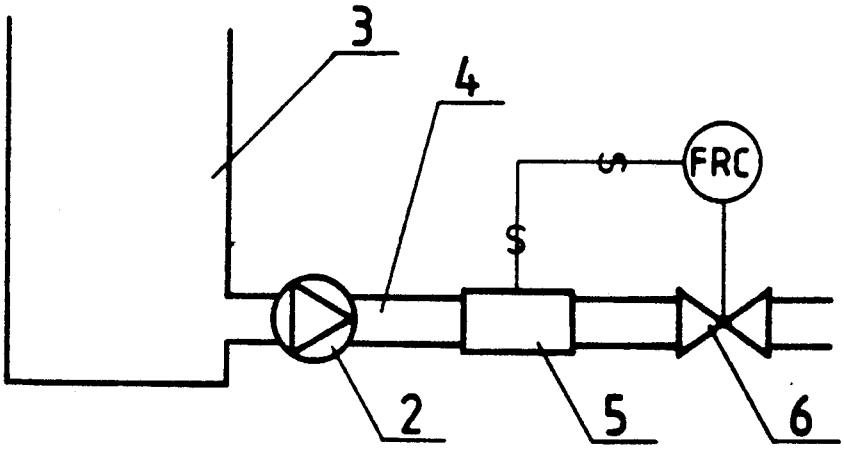
Fig 1b Prior art

There are in principle two earlier known types of control arrangements of pulp pumping. FIG. 1*a* shows a so called principle of level control, in which the output of the pump 2 is adjusted by the throttling arrangement 1 so that the level of the pulp in pulp container 3 remains constant. FIG. 1*b* illustrates a so called principle of flow control, in which pump 2 is attached to the pump container 3 and thereafter there is a flow indicator 5 arranged in the flow passage 4 through which a pulp flow passes, which flow is maintained constant by the throttling arrangement 6. In both cases the valve is disposed considerably far from the pump and, in any case, so far that medium/high consistency pulp has time to form rigid fiber networks and the flow time enough to change into plug flow. The subsequent pressing of the pulp through the throttling arrangement involves a great loss of pressure. Additionally, it has to be noted that even by bringing a throttling arrangement as close to the pump as possible it is not possible to completely avoid the pulp from beginning to solidify, because the formation of the fiber network begins already in the pump itself just after the fluidization zone of the pump.

Figure 2:
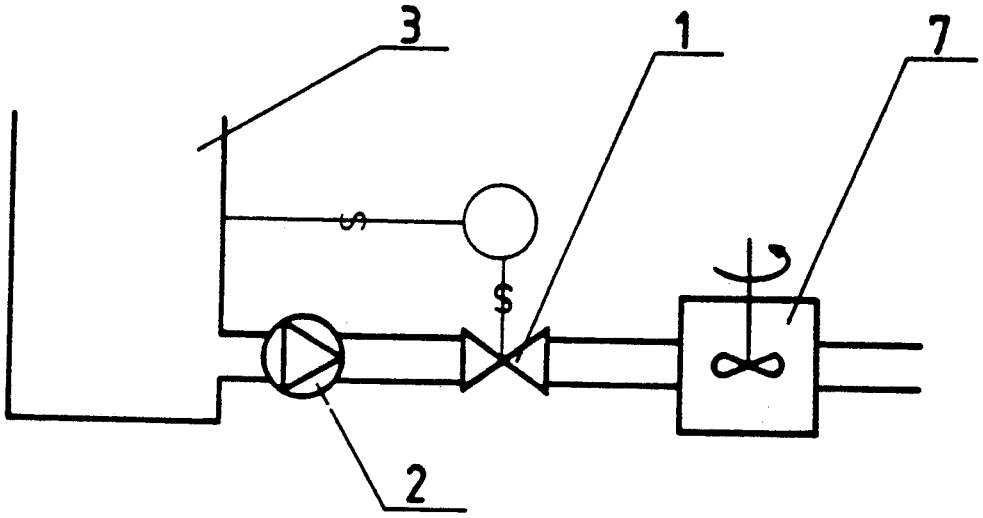
Fig 2 Prior art
FIG. 2 is a schematic illustration of a mixing arrangement according to the prior art.

FIG. 2 shows an arrangement according to the prior art, for example, for mixing bleaching chemicals to the suspension. The arrangement comprises a pulp vessel 3, a pump 2, a level control valve 1 and a mixer 7 following the valve 1 in the direction of pulp flow, which mixer can be similar to the fluidizing mixer mentioned above. Drawbacks of this arrangement are a considerable overall loss of pressure of the devices especially with high consistency pulps and the costs of the devices made of special materials. Additionally, the fluidizing mixer, if used, does not mix the chemicals in the suspension evenly.

Figure 3:
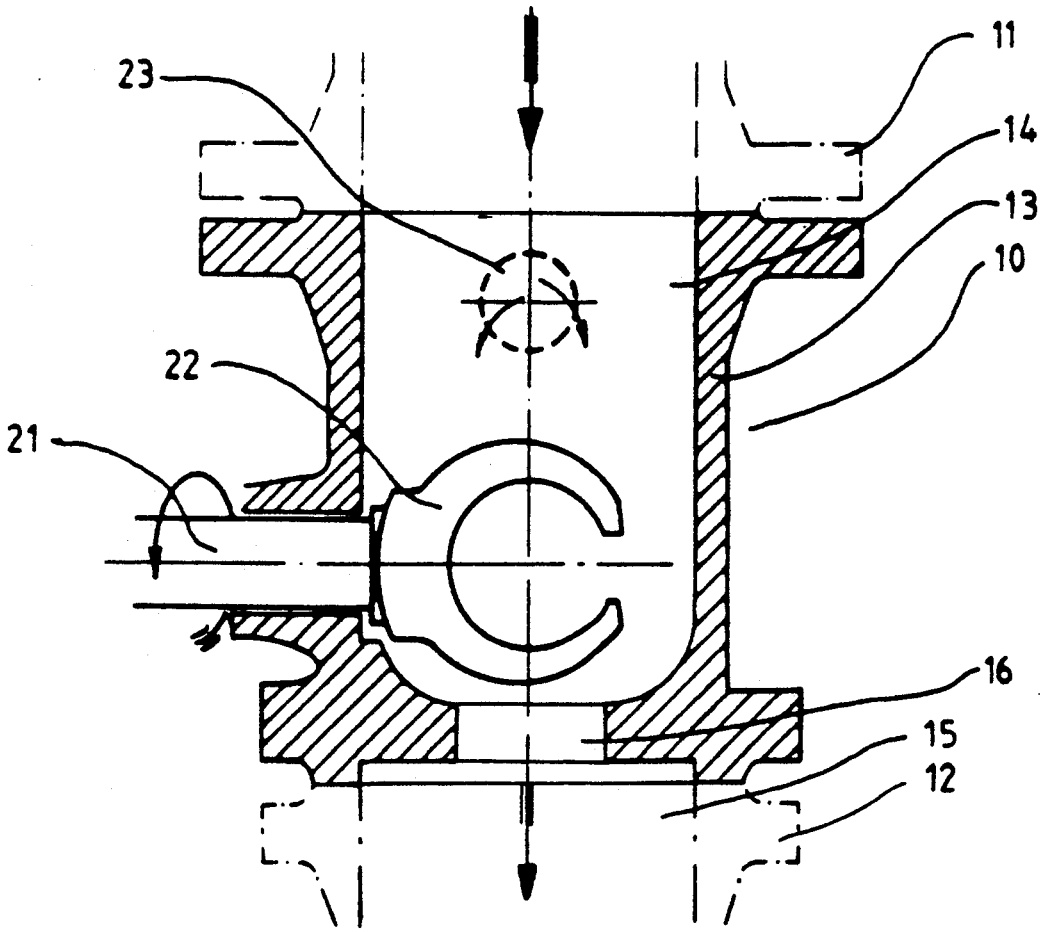
FIG. 3 is a sectional side view of a preferred embodiment of a throttling apparatus according to the present invention.

FIG. 3 discloses a throttling arrangement in accordance with the present invention in which said arrangement 10 comprises in general a substantially cylindrical or sometimes almost ball shaped chamber 13 provided with an inlet 14 connected to an inlet pipe 11 and an outlet 15 connected to an outlet pipe 12. Said inlet pipe 11 may be mounted at its other end to a fluidizing centrifugal pump, but any type of pump capable of delivering medium/high consistency pulp may be used. The inlet 14 of the chamber 13 is provided with an inlet opening 23 (shown by a dotted circle) for chemicals through which opening, for instance, bleaching chemicals may be beforehand added into the pulp flow prior to mixing. Said opening for the chemicals may, however, be located almost anywhere upstream of said throttling arrangement. The outlet 15 is provided with a throttling 16, i.e. an area having a reduced diameter with respect to both the chamber 13 and the outlet pipe 12. It is essential to the operation of our invention that the diameter of the chamber 13 is equal or less than that of the inlet and outlet pipe. According to FIG. 3 a substantially radial shaft 21 protrudes through the wall of the chamber 13 and a fluidizing element 22 is attached to the other end of said shaft 21 inside the chamber 13. Although the position of the shaft 21 is shown in FIG. 3 as being substantially radially or perpendicular to the direction of flow or the axis of the chamber 13, shaft 21 may also deviate from that perpendicular position by up to about 30°. Said fluidizing element may be a rotor having a plurality of substantially axially located blades. Said blades are preferably formed of an elongated steel plate having a rectangular cross-section and having radially an inner and an outer edge. The blades may, however, be of any appropriate form as long as the center of the rotor is open. The blades are arranged with said inner edges located at a distance from the axis of the rotor in such a way that the center of the rotor is open, thus allowing the fiber suspension to flow through the center of said rotor, whereby the rotor itself causes as little resistance to the flow as possible. The blades may be either straight axial or somewhat arcuate thus forming a cylinder, ball or barrel shaped envelope surface during rotation thereof. Preferably, the rotor is provided with more than two blades so that always at least one of the blades is creating turbulence in the suspension. In other words, the otherwise entirely open space between rotating blades and through the rotor is being prevented. Nevertheless, the rotor, at the same time, permits the suspension flow to pass through the blades and thus through the rotor.

As mentioned, the direction of the shaft 21, however, may greatly differ from the radial direction i.e. it may be inclined with respect to the axial direction of the chamber 13 so far that it is clearly non-axially disposed within said chamber. The reason for this is the mixing ability, as, while the direction of the shaft is non-axial, the fiber suspension flow through the apparatus due to the pressure created by the pump prior to the throttling arrangement prevents the rotor from forming a gas bubble in the middle of the flow. A characterizing feature of a fluidizing, centrally open rotor is that it tends to separate gas from liquids. But as the rotational movement which the rotor causes in the suspension is not coaxial with the main flow direction, a gas bubble is not able to grow in the middle of the rotor.

The operation of the apparatus is such that the fiber suspension flow from a pump, for instance, from a fluidizing centrifugal pump, is introduced to chamber 13 through inlet 14 and simultaneously chemicals are fed through opening 23, either located in connection with the throttling arrangement or somewhere upstream thereof, to the fiber suspension. The fluidizing element i.e. the rotor while rapidly rotating causes the fiber suspension to fluidize whereby the chemicals are efficiently mixed throughout the suspension and are capable of contacting each fiber of the suspension. Due to the feed pressure created by the pump the suspension flows through the apparatus towards the outlet being provided with the throttling whereby the pressure difference over the throttling causes the suspension to turbulate when passing the throttling further facilitating the mixing of chemicals.

There is yet another attractive feature relating to the rotating fluidizing element and the following throttling. As the fluidizing rotor facilitates the flow through said throttling i.e. tends to reduce the back pressure caused by the reduced diameter of the throttling it is possible to control the flow through the throttling by only controlling the degree of fluidization i.e. the strength of the shear force field created by the rotor. Thus by adjusting the rotational speed of the fluidizing element it is easy to control the amount of resistance the throttling subjects to the flow of suspension.

Figure 4:
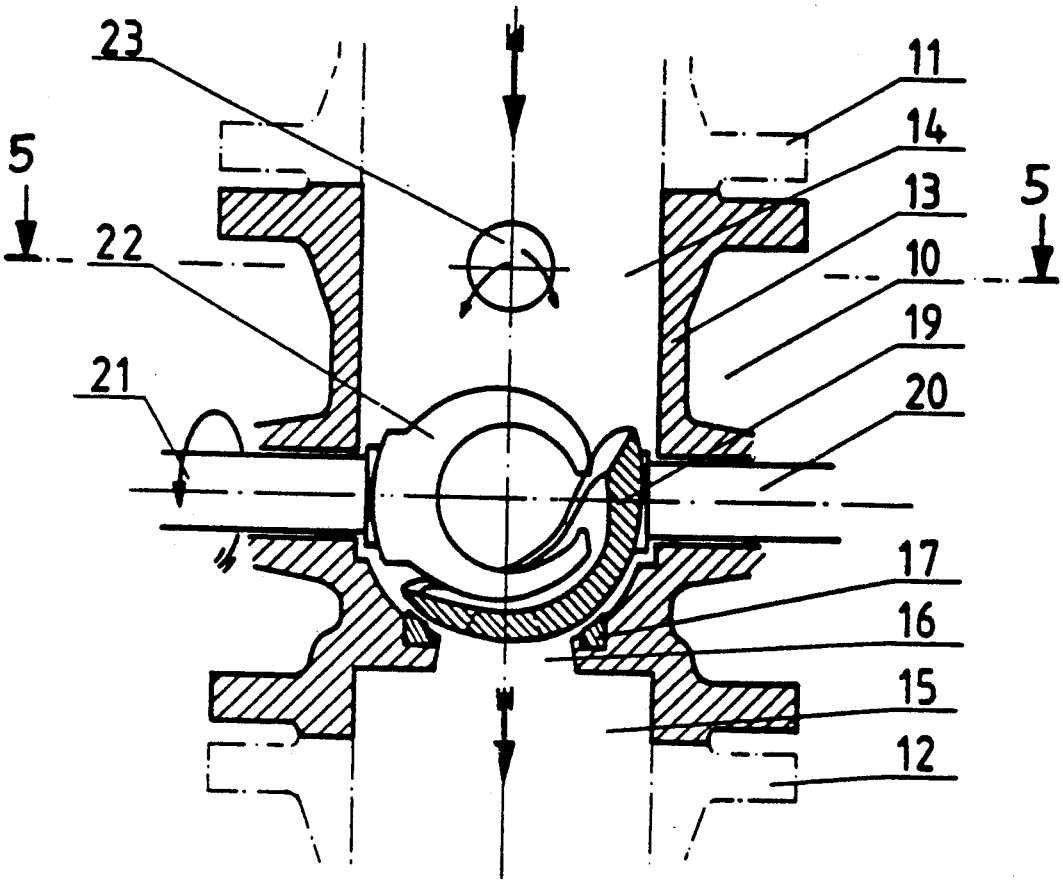
FIG. 4 is a sectional side view of a preferred embodiment of an adjustable mixing valve according to the present invention.
Figure 5:
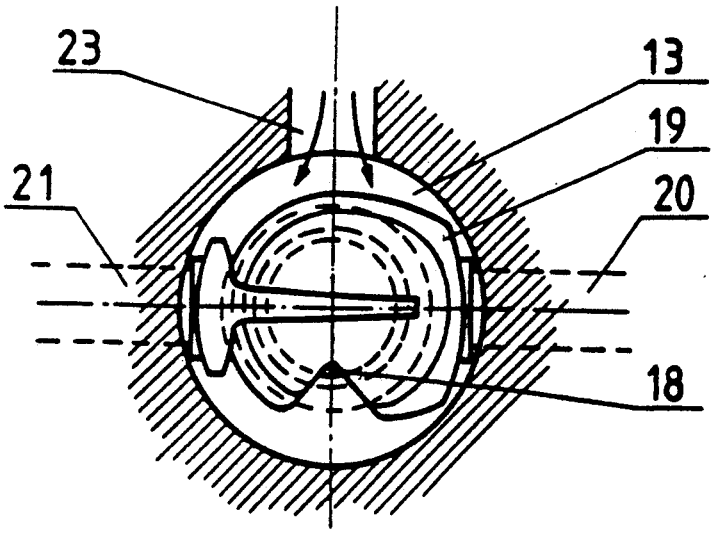
FIG. 5 is a fragmentary detail of a valve arrangement according to FIG. 4 as viewed from the incoming direction.

FIGS. 4 and 5 illustrate another preferred embodiment of the invention, the difference being the type of throttling after the chamber 13. In the chamber 13 there is a throttling 16 being provided with a seat ring 17 for an adjustable calotte valve 19 with a V-opening 18, the inner and outer surface of which valve are a part of a spherical surface. The angular position of the calotte valve 19 is controlled by a control spindle 20 protruding from the chamber 13. According to FIG. 4 the control spindle 20 is coaxial with the shaft 21 of the fluidizing element 22 so that said element rotates close to the inner side of the curved surfaced of the calotte valve 19. By means of this arrangement it is ensured that the fibers cannot clog the V-opening 18 of the calotte valve 19.

The above described main components are preferably situated in the chamber as described above in relation to the direction of the pulp flow: firstly the chemicals feed opening, secondly the fluidizing element 22, then the calotte valve 19, and then the throttling 16. It is, however, also possible to position the throttling arrangement in the opposite disposition with the fluidizing element behind the valve element in the direction of flow so as to hinder the fibers which might stick on the edges of the valve opening. However, the feed opening for chemicals has to be arranged always upstream of the fluidizing element. Also, the directions of the shafts of the rotor and the throttling arrangement can differ from each other or one of the shafts can be within the other.

The valve member may also be arranged as a separate unit immediately after the fluidizing element as shown in FIGS. 6*a* and 6*b*. The embodiment of FIG. 6*a* discloses a throttling arrangement 10 mainly similar to the one described in connection with FIG. 3. However, this embodiment includes a separate adjustable valve element 25 attached to the throttled outlet 15 of the chamber 13. It is to be noted that the structure of the valve may be very simple as the distance from the fluidizing element 22 to the valve member 26 is very short. The valve as shown in FIG. 6*a* is formed of a valve element 25 having a central opening and a sliding valve member 26 arranged in the radial grooves in the walls of the central opening. The valve member 26 may be provided with a V-shaped opening 27 similar to the one shown more closely in FIG. 5. The sliding valve member is connected to its operating means by means of a rod 28. By sliding the valve member radially the flow area of the valve may be adjusted accurately as the fluidizing rotor prevents the fibers of the suspension from sticking to the walls of the valve opening.

FIG. 6*b* shows a throtting arrangement 10 which is similar to that described in FIG. 4 above, with the main exception that adjustable calotte valve 19 is disposed downstream throttling 16. Valve 19 is rotatably mounted on shaft 20 extending through the suspension outlet 15. Preferably, valve 19 is also provided with a V-shaped opening as discussed in connection with FIGS. 4 and 5. Valve 19 has an at least partially spherical or arcuate outer surface preferably conforming to the inner surface of suspension outlet 15. Adjustable valve 19 cooperates with seat ring 17 for improving the sealing performance of the valve.

The throttling arrangement according to several embodiments of the invention functions in the following way. With medium or high consistency pulp, when the pulp flow coming from the pump reaches the chamber of the throttling arrangement in the form of a plug flow, chemicals are introduced in said chamber before the pulp is subjected by the fluidizing element rotating within the chamber to create such an amount of shear forces that the bonds between the fibers forming a stiff fiber network, i.e. a pulp plug, loosen and the pulp flows like a fluid through the throttling arrangement. Simultaneously, as the fibers of the pulp suspension are loose in the flow, the chemicals are efficiently mixed with the fibers in such a way that each fiber will be in contact with the chemicals and, as it is impossible for the chemicals to be separated in the form of the bubbles from the suspension, the mixing is even and the dosage of chemicals may be minimized. The loss of pressure caused by the throttling arrangement is consequentially only a fraction of what it would be without fluidization. The most difficult situation is when the flow channel defined by the valve element 19 and the throttling 16 is very small, in other words the volumetric flow is small. Then the fibers stick very easily on the edges of the flow channel and gather together forming in a short time a plug which clogs the throttling arrangement. It is, however, possible to design the fluidizing element so that it causes a pulse at the flow channel against the normal direction of flow, in other words it tends to draw off the fiber bundles stuck to the edge of the opening and to return them to the fluidizing area. If a rotating rotor is involved, the fiber bundles can be loosened also by the total effect of the structure of the valve element and the rotational direction of the rotor.

FIG. 7 discloses an arrangement according to the present invention, in which the throttling arrangement 10 is used as a mixer. A pump 2 is connected to a pulp tank 3 and the pump is followed by a throttling arrangement 10 situated at an appropriate location and, according to the embodiment in the figure is controlled by a level detector. The arrangement in FIG. 7 can well be compared to the arrangement in FIG. 2 because in both cases the same measures are involved: control of the pump and mixing of chemicals. However, the equipment in FIG. 7 is much simpler and an additional advantage is achieved by the higher outlet pressure compared to that of FIG. 2.

The throttling arrangement according to the invention can be employed, for example, in an apparatus in which pulp is led from the MC®-pump to the thickener which requires a certain counter pressure to function in the desired way. Consequently, the consistency of the pulp flow being throttled can easily be more than 15%, even 20%, whereby to ensure the flow (in other words hindrance of the clogging of the throttle point) of the pulp, fluidization of the pulp is required immediately before the throttling arrangement. Hereby the throttling arrangement is to be situated preferably exactly at the outlet opening of the thickener, because at the same time as the valve throttles the flow, it also enables the discharge of the pulp from the thickener. Similarly, the throttling arrangement can also be used in connection with other components of the treating of high consistency pulp.

FIG. 8*a* illustrates the behavior of a conventional valve with high consistency pulps. The test consistencies were 8, 10, 13 and 15%. The horizontal axis shows the angle of the opening or spread angle of the throttling arrangement and the vertical axis the mass flow passing through the throttling arrangement. It will be appreciated from the graph that at a consistency of 10% the flow rate of the pulp begins to decrease significantly at large spread angles and at a consistency of 15% the value of the pulp flow remains below half of the maximum valve which is achieved by water. Correspondingly, at small spread angles it is to be noted that a consistency of 15% requires a spread angle at least double the size of that of water even to start the flow. Thus the control of small amounts of flow is by conventional throttling arrangements most complicated, if not impossible.

FIG. 8*b* correspondingly represents the behavior of the throttling arrangement according to the invention at high consistencies. It is seen in the same coordinates that at small spread angles the 15% pulp does not differ from water, so the adjustability is as good as that of water. At larger spread angles the 15% pulp requires a little larger spread angle than water, but the curve does not turn horizontal as occurred with the throttling arrangements according to the prior art.

FIG. 9 discloses comparative curves of the capacity (y-axis) of the throttling arrangement as a function of the pressure difference prevailing across the throttling arrangement. The curves show the $Q_{pulp}/Q_{water}$ relation of the volumetric flows, which with the throttling arrangements in accordance with the prior art (broken line curves) is weak already at the consistency of 10%. In other words, a considerable pressure difference is required for the efficiency of the flow to reach a profitable value. At the consistenecy of 15% the pressure difference required is even bigger. By the means of a throttling arrangement according to the invention (unbroken curve) a considerably better efficiency is achieved and the maximum value achieved with considerably small pressure difference is, less than half of the corresponding pressure difference of a throttling arrangement in accordance with the prior art.

The following table shows very clearly the difference between the apparatus in accordance with our invention and the mixers of prior art.

| Mixer Type Manufacturer | Consistency % | Energy Expenditure MJ/t pulp (t = tons) |
|---|---|---|
| Beloit-Rauma | 10 | 13–28 |
| Ingersoll-Rand | 9–16 | 8–15 |
| Kamyr MC* | 9–14 | 14–43 |
| Sund MC | 9–14 | 9–18 |
| AHLMIX* (invention) | 5–25 | 1–3 |

As can be seen from the table above the apparatus in accordance with the present invention operates efficiently in a far wider consistency range than the prior art mixers. Also the energy expenditure of our apparatus is approximately one tenth of that of the competing mixers. The reason for this is the compact structure of our apparatus. The volume of the chamber of our apparatus is very small and as the fluidizing element has an open center and as it rotates non-axially with the chamber or at least with its outlet, the turbulence field it creates easily fills the entire chamber consuming minimal amount of energy for fluidizing the suspension.

The above described arrangement according to the invention has thus made it possible to avoid or minimize the drawbacks and defects of the devices according to the prior art by simplifying the apparatus by combining applicable components with a rational entity. However, only a few specially preferable embodiments have been referred to above and such are not intended to limit the scope of the invention of what is claimed in the appended claims. It is, for example, clear that it is not necessary to use a calotte valve with a V-opening but in some cases the use of a slide valve as well as a ball or a disc valve can be justified. Similarly, it is not necessary for the fluidizing element to be a rotor as in the figures, but also another kind of vibrator can be used.

It is also clear that the material being used does not need to be high consistency pulp, but the mixing is applicable also to diluted pulps or mere fluids. Similarly, the substances or chemicals to be mixed can be either gaseous, liquids or solids.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A method of treating a fiber suspension having a consistency of from 5–25% in an apparatus within a fiber suspension transfer line, said apparatus comprising a chamber having an axis in the direction of flow of said fiber suspension, a suspension inlet and a suspension outlet having an axis in alignment with said chamber axis; a fluidizing rotor having an axis of rotation transversely to said direction of flow and being disposed within said chamber for rotation therein, said rotor comprising blades, each blade having a proximal and distal end and said blades diverging from said proximal end and extending in spaced relation from said axis of rotation along an axial length thereof; said method comprising:

feeding said suspension from said suspension tranfer line through said inlet into said chamber;

introducing chemicals into said fiber suspension upstream of said fluidizing rotor;

rotating said fluidizing rotor within said chamber so as to form an open center bounded by a surface of revolution and subjecting said suspension moving toward said outlet to a shear force field sufficient to fluidize said suspension, to mix said chemicals evenly into said suspension and to render said suspension flowable; flowing said suspension through said open center of said rotor; and discharging said suspension from said chamber through said suspension outlet.

2. The method of claim 1, wherein the rotating step for fluidizing said suspension is performed by supplying energy to said fiber suspension in an amount less than 5 MJ per metric ton of fiber suspension.

3. The method of claim 1, the apparatus additionally comprising a throttling device downstream of said fluidizing rotor, the method additionally comprising the step of flowing said suspension through said open center of said rotor toward and through said throttling device.

4. The method of claim 3, additionally comprising the step of maintaining a fluidized state of said suspension through said throttling device for preventing said fibers from forming flocs within said chamber and from attaching to the edges of said throttling device.

5. The method of claim 1, wherein said inlet and said outlet each have a diameter, additionally comprising the step of minimizing the energy consumption of the fluidizing step by arranging the size of said chamber as small as possible relative to said diameter of said inlet and said outlet.

6. A method of treating a fiber suspension having a consistency of from 5–25% in an apparatus within a fiber suspension transfer line, said apparatus comprising a chamber defined by a wall having an inner surface, an axis in the direction of flow of said fiber suspension, a suspension inlet and a suspension outlet, a fluidizing rotor having an axis of rotation substantially at a right angle to said direction of flow and being disposed within said chamber for rotation therein, said rotor comprising a shaft having an end, said end of the shaft located at the inside surface of said chamber, and blades being attached to said end of the shaft, each blade having a proximal and distal end and said blades diverging from said proximal end and extending in spaced relation from said axis of rotation along an axial length thereof, said method comprising:

feeding said suspension from said suspension transfer line through said inlet into said chamber;

introducing chemicals into said fiber suspension upstream of said fluidizing rotor;

rotating said fluidizing rotor within said chamber so as to form an open center bounded by a surface of revolution and subjecting said suspension moving toward said outlet to a shear force field sufficient to fluidize said suspension and to render said suspension flowable;

flowing said suspension through said open center of said rotor; and discharging said suspension from said chamber through said suspension outlet.

* * * * *